US010391552B2

(12) United States Patent
Tilch et al.

(10) Patent No.: US 10,391,552 B2
(45) Date of Patent: Aug. 27, 2019

(54) CASTING MOULD AND PISTON PRODUCED WITH THE CASTING MOULD

(71) Applicant: Mahle International GmbH, Stuttgart (DE)

(72) Inventors: Peter Tilch, Oelbronn-Durrn (DE); Dieter Zarges, Remshalden (DE)

(73) Assignee: Mahle International GmbH (DE)

( * ) Notice: Subject to any disclaimer, the term of this patent is extended or adjusted under 35 U.S.C. 154(b) by 70 days.

(21) Appl. No.: 15/027,979

(22) PCT Filed: Sep. 23, 2014

(86) PCT No.: PCT/EP2014/070166
§ 371 (c)(1),
(2) Date: Apr. 7, 2016

(87) PCT Pub. No.: WO2015/051991
PCT Pub. Date: Apr. 16, 2015

(65) Prior Publication Data

US 2016/0236273 A1 Aug. 18, 2016

(30) Foreign Application Priority Data

Oct. 8, 2013 (DE) ..... 10 2013 220 256

(51) Int. Cl.
*B22D 17/22* (2006.01)
*B22C 9/06* (2006.01)
(Continued)

(52) U.S. Cl.
CPC ..... *B22D 17/2245* (2013.01); *B22C 9/06* (2013.01); *B22D 25/02* (2013.01); *F02F 3/00* (2013.01);
(Continued)

(58) Field of Classification Search
CPC ..... B22D 17/2245; B22D 25/02; F02F 3/02; F02F 3/00; F02F 3/0076;
(Continued)

(56) References Cited

U.S. PATENT DOCUMENTS 4,250,950 A * 2/1981 Buxmann ..... B22D 11/0654 164/122
5,318,091 A * 6/1994 Pavoni ..... B22C 23/02 164/6
(Continued)

FOREIGN PATENT DOCUMENTS

CH 547140 A 3/1974
CN 102667125 A 9/2012
(Continued)

OTHER PUBLICATIONS

English abstract for EP-2133165.
(Continued)

*Primary Examiner* — Leith S Shafi
(74) *Attorney, Agent, or Firm* — Fishman Stewart PLLC

(57) ABSTRACT

A casting mold for casting a piston for an internal combustion engine may include a mold body having a surface texture in a region corresponding to a subsequent internal surface of a piston skirt. The surface texture may be defined by a plurality of grooves. The plurality of grooves may have the following dimension: a depth of 0.2 mm<t<0.5 mm, a width of 0.02 mm<b<0.05 mm, and at least two groove walls which are inclined outwardly at 0°<α<10°.

15 Claims, 1 Drawing Sheet

(51) Int. Cl.
*B22D 25/02* (2006.01)
*F02F 3/00* (2006.01)
*F02F 3/02* (2006.01)

(52) U.S. Cl.
CPC ..... *F02F 3/0076* (2013.01); *F02F 3/02* (2013.01); *F02F 2003/0007* (2013.01)

(58) Field of Classification Search
CPC ..... F02F 2003/0007; B22C 9/06; B22C 7/00; B22C 3/00; B22C 9/18; B22C 23/02; B21B 2261/14; B29C 33/3842; B29C 33/42; B29C 2033/422; B29C 37/0053; B29C 39/36; B29C 39/22; B29C 39/026; B29C 33/58; B29C 33/56; Y10T 29/49972
USPC ..... 123/193.6, 193.4, 193.1; 249/114.1, 141; 29/526.2; 427/135; 264/338, 446
See application file for complete search history.

(56) References Cited

U.S. PATENT DOCUMENTS 5,857,440 A * 1/1999 O'Dowd ..... F02F 3/00 123/193.6
8,573,284 B2 11/2013 Schmitz
2006/0051000 A1 3/2006 Etsion et al.
2011/0073061 A1* 3/2011 Chae ..... F02F 3/0076 123/193.6
2012/0052194 A1* 3/2012 Hirano ..... B22C 9/061 427/133
2013/0068176 A1 3/2013 Medvedec et al.
2013/0295304 A1* 11/2013 Moore ..... C04B 35/6265 428/34.6
2015/0027655 A1* 1/2015 Yuki ..... B22C 9/18 164/271

FOREIGN PATENT DOCUMENTS

DE 1934894 A1 1/1970
DE 69217837 T2 10/1997
DE 102009037283 A1 2/2011
DE 102011082935 A1 3/2013
EP 2133165 A1 12/2009
GB 1279806 A 6/1972
JP S52-32817 A 3/1977
JP S63-256251 A 10/1988
JP H08-309486 A 11/1996
WO WO-2012175323 A1 12/2012

OTHER PUBLICATIONS

German Search Report for DE-102013220256.3, dated Apr. 16, 2014.
Chinese Office Action dated Dec. 30, 2016 related to Chinese Patent Application No. 201480051867.8.
Japanese Office Action dated Sep. 4, 2018 related to corresponding Japanese Patent Application No. 2016-521676.

* cited by examiner

CASTING MOULD AND PISTON PRODUCED WITH THE CASTING MOULD

CROSS-REFERENCE TO RELATED APPLICATIONS

This application claims priority to German Patent Application No. 10 2013 220 256.3, filed Oct. 8, 2013, and International Patent Application No. PCT/EP2014/070166, filed Sep. 23, 2014, both of which are hereby incorporated by reference in their entirety.

TECHNICAL FIELD

The present invention relates to a casting mold for casting a piston for an internal combustion engine. The invention also relates to a piston cast in such a casting mold.

BACKGROUND

When casting internal combustion engine pistons, sufficient removal of air during the casting process must always be ensured, in order in particular to avoid undesirable cavities. In this context, a surface texture referred to as a waffle pattern has proven advantageous in the prior art, which surface texture makes it possible to improve not only the flowability of the casting material but also the removal of air. However, the known waffle pattern has the drawback that it must be introduced in the pull direction of the casting mold, since demolding of the cast piston which lies outside the waffle pattern drafts produces an undercut and can thus result in damage to the cast piston. Nonetheless, such surface textures are thoroughly desirable, and not only for improved removal of air but also for identifying the origin of the piston produced with this casting mold.

SUMMARY

The present invention thus addresses the problem of specifying a casting mold which in particular has markedly increased flexibility with respect to a demolding direction.

This problem is achieved, according to the invention, with the subject matter of the independent claim(s). Advantageous embodiments form the subject matter of the dependent claims.

The present invention is based on the general concept of now providing, in a casting mold which is known per se for casting a piston for an internal combustion engine, in the region of a subsequent internal surface of a piston skirt, a surface texture which is formed by grooves and which permits demolding of the casting blank up to approximately 90° with respect to the surface texture, that is to say parallel to the surface texture. To that end, the grooves forming the surface texture have according to the invention a depth of $0.2\ \text{mm}<t<0.5\ \text{mm}$, a width of $0.02\ \text{mm}<b<0.05\ \text{mm}$ and groove walls which are inclined outward at $0°<\alpha<10°$. The cross section of such a groove is thus trapezoidal. The grooves according to the invention are smaller and also steeper than previous grooves forming a surface texture and contribute to optimum de-airing of the casting mold during the casting process being possible, but the casting metal does not penetrate into the grooves where it would get caught in the manner of an undercut. Generally, the surface texture according to the invention is freely configurable, although it is important to ensure that the individual grooves can be de-aired. In that context, the surface texture can be used with or without shield gas, and with or without release agent or with or without a permanent coating, and also with a combination of a permanent coating and release agent. A particular advantage of the surface texture according to the invention having the above-described grooves is that this generates a surface texture with an appearance which is difficult to imitate, and which can serve as proof of origin.

In one further advantageous embodiment of the solution according to the invention, the grooves form a quadrilateral structure. Such a quadrilateral structure can for example be a rectangular structure or a rhombus structure, which can in particular also be termed a waffle pattern, and which permit demolding of the casting blank from the casting mold in almost all directions, that is to say up to approximately parallel to the surface.

In one advantageous development of the solution according to the invention, the grooves are created by means of a laser. The creation of such grooves and, also indirectly thereby, such surface textures by means of a laser represents a cost-effective and simultaneously high-quality production method.

Advantageously, a coating, in particular a release agent, is applied to the surface texture. Such a coating can at least partially narrow the entrance of the groove and thus make it more difficult for the casting material to penetrate therein. At the same time, the coating does not close the individual grooves, such that the removal of air can be ensured even with a coating, in particular a permanent coating or release agent. In order to increase the service life of the tools, suitable options include metallic or ceramic coatings or combinations thereof.

Further important features and advantages of the invention can be found in the subclaims, the drawings and the associated description of the figures with reference to the drawings.

Of course, the features mentioned above and those still to be explained below can be used not only in the combination indicated in each case, but also in other combinations or alone, without departing from the scope of the present invention.

Preferred exemplary embodiments of the invention are presented in the drawings and are described in greater detail in the following description, wherein identical reference signs relate to identical or similar or functionally identical components.

BRIEF DESCRIPTION OF THE DRAWINGS

In the drawings, in each case schematically.

DETAILED DESCRIPTION

Figure 1:
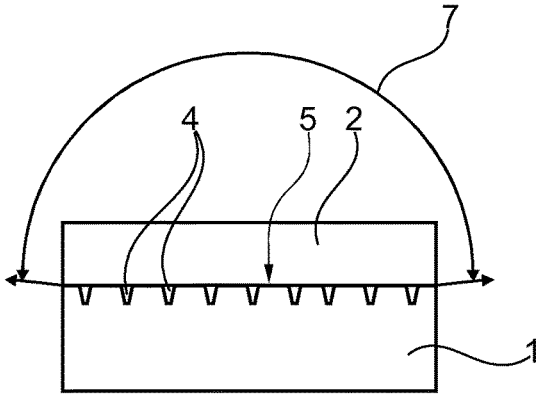
FIG. 1 shows a sectional representation through a casting mold according to the invention for casting a piston, with the demolding direction indicated.
Figure 2:
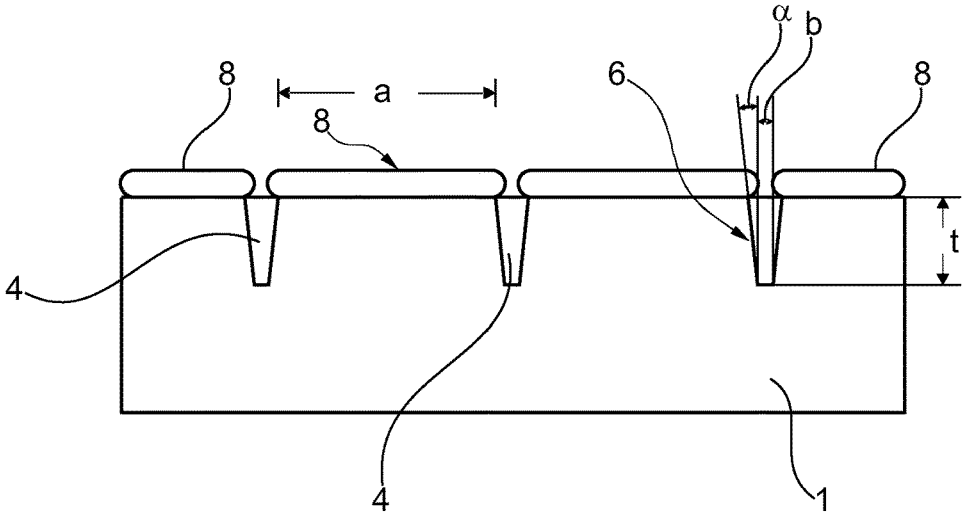
FIG. 2 shows a detail representation of the casting form in the region of a surface texture.

As shown in FIGS. 1 and 2, a casting mold 1 according to the invention, for casting an internal combustion engine piston 2 (cf. FIG. 3) of which only certain regions are represented, has, in the region of a subsequent internal surface 3 of a piston skirt, a surface texture 5 formed by grooves 4. In that context, the grooves 4 have according to the invention the following dimensions: a depth t which is between 0.2 mm and 0.5 mm (cf. FIG. 2), a width b which is between 0.02 mm and 0.05 mm, and groove walls 6 which are inclined outward, wherein an outward inclination of the groove walls 6 is between $0° < \alpha < 10°$. The grooves 4 formed according to the invention make it possible, in contrast to previous surface textures, to demold a cast piston 2 in almost any direction, in particular even up to approximately parallel to a surface of the surface texture 5, as is shown in FIG. 1. In that context, the arc 7 illustrated in FIG. 1 indicates the possible demolding angles, it being clear that the piston 2 can be demolded from the casting mold 1 in almost any direction through approximately 180°. This was not possible in the case of previous surface textures, since these could be created only in the pull direction of the casting mold. Demolding beyond the waffle pattern drafts or beyond the groove drafts produced an undercut and inevitably led to damage to the cast part, i.e. in the present case the piston 2.

The casting mold according to the invention no longer has this drawback since, in the case of this casting mold, the surface texture 5 is configured such that the casting material cannot penetrate into the surface texture 5, i.e. in particular not into the grooves 4, and thus permits a large degree of freedom with respect to the demolding direction, since no undercuts are produced. Nonetheless, the grooves 4 according to the invention, or the surface texture 5 produced thereby, also permit an improvement in the flowability and in the removal of air during the process of casting the piston 2.

Figure 3:
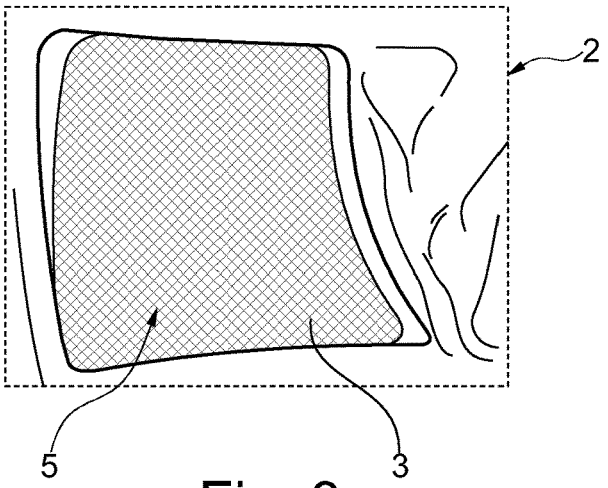
FIG. 3 shows a view of the surface texture according to the invention on an internal surface of a piston skirt.

FIG. 3 shows that the grooves 4 form a quadrilateral structure, for example a square waffle pattern or a rhombus structure.

FIG. 2 shows that, between two adjacent grooves 4, there is provided a separation a which is between 0.2 mm and 2.0 mm. Creating the grooves 4 and thus the surface texture 5 in the casting mold 1 can be carried out for example by means of a laser, by means of which the grooves 4 can be created not only extremely precisely but also relatively cost-effectively. Furthermore, a particular configuration of the surface texture 5 can be used to create a mark of origin, such that the piston 2 cast using the casting mold 1 according to the invention can unambiguously and easily be attributed to a certain producer.

FIG. 2, once again, shows that the casting mold 1 can also have a coating 8, in particular a release agent, in the region of the surface texture 5. Release agents are generally understood to be coating materials which for example are applied to casting molds 1 in order in particular to smooth over a porous mold part surface. To that end, the base material used is for example finely ground, refractory to highly refractory materials. Such a coating 8 or release agent additionally insulates the substrate and protects it from the thermal load due to the metal melt during casting of the piston 2. The surface texture 5, or the grooves 4 forming the former, can for example be created with or without shield gas. Generally, the grooves 4 according to the invention are smaller and steeper than grooves of previous surface textures, making it possible to at least reduce or preferably even avoid penetration of the melt during the casting process and thus the formation of undesirable undercuts; the de-airing required for optimum casting can however be reliably ensured.

Thus, with the casting mold 1 according to the invention, substantial advantages can be achieved, namely:

almost any demolding direction, an indication of origin by means of a certain configuration of the surface texture 5, reliable de-airing during casting of the piston 2.

The invention claimed is:

1. A casting mold for casting a piston for an internal combustion engine, comprising: a mold body having a surface texture in a region corresponding to a subsequent internal surface of a piston skirt, wherein the surface texture is defined by a plurality of grooves respectively having at least two groove walls inclined outwardly from one another, and wherein the plurality of grooves have the following dimensions:

a depth of $0.2\ mm < t < 0.5\ mm$, a width of $0.02\ mm < b < 0.05\ mm$, and an outward inclination of the at least two groove walls of $0° < \alpha < 10°$, wherein the plurality of grooves are open along the depth thereof and taper outwardly in a direction away from the mold body such that a distance between the at least two groove walls of the plurality of grooves increases towards an entrance of the plurality of grooves, wherein the mold body includes a release coating disposed on the surface texture, wherein the coating at least partially narrows the entrance of the plurality of grooves without closing the plurality of grooves along the depth thereof.

2. The casting mold as claimed in claim 1, wherein the plurality of grooves define a quadrilateral structure.

3. The casting mold as claimed in claim 1, wherein at least two grooves of the plurality of grooves have a distance of approximately $0.2\ mm < a < 2.0\ mm$ between one another.

4. The casting mold as claimed in claim 1, wherein the plurality of grooves are laser-cut grooves.

5. The casting mold as claimed in claim 1, wherein the surface texture has a square waffle pattern.

6. The casting mold as claimed in claim 2, wherein at least two grooves of the plurality of grooves have a distance of approximately $0.2\ mm < a < 2.0\ mm$ between one another.

7. The casting mold as claimed in claim 6, wherein the surface texture has a square waffle pattern.

8. The casting mold as claimed in claim 1, wherein the plurality of grooves respectively have a trapezoidal cross-section where the distance between the at least two groove walls increases continuously from a groove base to the entrance of the plurality of grooves.

9. The casting mold as claimed in claim 1, wherein the plurality of grooves define a rhombus structure.

10. The casting mold as claimed in claim 1, wherein the plurality of grooves are open outwardly from a groove base to the entrance, and wherein the depth of the plurality of grooves respectively extends from the groove base to the entrance.

11. A casting mold for casting a piston of an internal combustion engine, comprising:

a mold body having a surface texture structured and arranged to cast a pattern on a surface of a piston skirt, the surface texture defined by a plurality of grooves;

wherein the plurality of grooves include the following dimensions:

a depth extending from a groove entrance to a groove base of $0.2\ mm < t < 0.5\ mm$;

a width of $0.02\ mm < b < 0.05\ mm$; and at least two groove walls inclined outwardly at an angle of $0° < \alpha < 10°$ such that the width of the plurality of grooves increases from the groove base to the groove entrance and provides the plurality of grooves with an outwardly tapered structure to impede penetration of a metal casting melt of a casting blank into the plurality of grooves and facilitates demolding of the casting blank up to approximately parallel with respect to the surface texture; and wherein the plurality of grooves are open outwardly from the groove base to the groove entrance, wherein the mold body includes a release coating disposed on the surface texture, wherein the coating at least partially narrows the entrance of the plurality of grooves without closing the plurality of grooves along the depth thereof.

12. The casting mold as claimed in claim 11, wherein the plurality of grooves define a waffle pattern.

13. The casting mold as claimed in claim 11, wherein the plurality of grooves have a trapezoidal cross-section defined by an outward inclination of the at least two groove walls where a distance between the at least two groove walls increases continuously in the direction away from the mold body.

14. A casting mold for casting a piston of an internal combustion engine, comprising:

a mold body having a surface texture structured and arranged to cast a surface pattern on a piston skirt, the surface texture provided by a plurality of outwardly tapered grooves;

the plurality of outwardly tapered grooves having a depth extending from a groove entrance to a groove base of 0.2 mm<t<0.5 mm and a width of 0.02 mm<b<0.05 mm;

wherein the plurality of outwardly tapered grooves have groove walls extending along a respective plane inclined outwardly at an angle of $0° < \alpha < 10°$ and define a trapezoidal cross-section to impede penetration of a metal casting melt of a casting blank into the plurality of grooves and permit a demolding direction of the casting blank up to approximately parallel with respect to the surface texture; and wherein the plurality of outwardly tapered grooves are open outwardly from the groove base to the groove entrance, wherein the mold body includes a release coating disposed on the surface texture, wherein the coating at least partially narrows the entrance of the plurality of grooves without closing the plurality of grooves along the depth thereof.

15. The casting mold as claimed in claim 14, wherein the plurality of grooves have a distance of approximately 0.2 mm<a<2.0 mm between one another.

* * * * *